US012578113B2

(12) United States Patent
Stefanoski et al.

(10) Patent No.: US 12,578,113 B2
(45) Date of Patent: Mar. 17, 2026

(54) SYSTEMS AND METHODS FOR MANAGING MOISTURE

(71) Applicant: GM Cruise Holdings LLC, San Francisco, CA (US)

(72) Inventors: Zoran Stefanoski, San Francisco, CA (US); Fen Chen, Morgan Hill, CA (US); Yung-Pei Ko, Los Angeles, CA (US)

(73) Assignee: GM CRUISE HOLDINGS LLC, San Francisco, CA (US)

( * ) Notice: Subject to any disclaimer, the term of this patent is extended or adjusted under 35 U.S.C. 154(b) by 602 days.

(21) Appl. No.: 18/101,980

(22) Filed: Jan. 26, 2023

(65) Prior Publication Data

US 2024/0255169 A1 Aug. 1, 2024

(51) Int. Cl.

| | |
|---|---|
| ***F24F 11/63*** | (2018.01) |
| ***F24F 3/14*** | (2006.01) |
| ***F24F 11/89*** | (2018.01) |

(52) U.S. Cl.

CPC ..... *F24F 11/63* (2018.01); *F24F 3/1411* (2013.01); *F24F 11/89* (2018.01)

(58) Field of Classification Search

CPC .... F24F 11/63; F24F 11/89; F24F 3/14; F24F 3/1411; B01J 20/3042; B01J 20/267; B01J 20/06; B01J 20/34; B01D 53/26; F21V 31/03

See application file for complete search history.

(56) References Cited

FOREIGN PATENT DOCUMENTS

WO WO-9727042 A1 * 7/1997 ..... F21S 45/33

* cited by examiner

*Primary Examiner* — Sharon Pregler

(74) *Attorney, Agent, or Firm* — CANTOR COLBURN LLP

(57) ABSTRACT

Various technologies described herein pertain to systems and methods for managing moisture and preventing condensation. In one embodiment, a system is disclosed for managing moisture and preventing condensation that includes a housing having at least one porous layer or surface and a hygroscopic material disposed inside the housing. The porous layer allows water vapor to be transported to the hygroscopic material from an outside space to trap at least a portion of the outside space water vapor. The porous layer also allows heat generated by at least one electronic system or other heat source in the outside space to be transmitted to the hygroscopic material to release at least a portion of the water vapor trapped in the hygroscopic material back into the outside space.

20 Claims, 5 Drawing Sheets

SYSTEMS AND METHODS FOR MANAGING MOISTURE

BACKGROUND

Electrical and mechanical systems operate in a variety of environments. These environments include varying outside factors or environments. In one example, these outside factors include environmental conditions that vary widely. For example, seasonal changes such as winter, spring, summer and fall provide varying temperatures, humidity, pressure, etc. Even within a single day, outdoor environments can vary widely. For example, temperature and humidity (moisture) can vary throughout a single 24-hour period or day. Temperatures may be higher during the daylight times and lower during nighttime. Relative humidity may also vary widely including, for example, being lower during daylight times and higher at nighttime. Such frequently changed environmental factors could bring harmful impacts like condensation and thermal fatigue on electrical and mechanical systems.

To protect electronic systems from outside/environmental factors such as moisture, they are typically placed in an enclosure. These enclosures are rated for a variety of standards based on how well they protect against ingress of substances such as, for example, dust, liquids (e.g., water), and gases (e.g., water vapor). Nevertheless, sometimes substances do enter the enclosure, which can cause the enclosed systems and/or components to corrode, fail, or malfunction.

What is desired are systems and methods that address these and other issues related to the protection of electrical and/or mechanical components.

SUMMARY

This summary presents a simplified overview to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

Various technologies described herein pertain to systems and methods for managing moisture and/or condensation in various environments. In one aspect, a system is disclosed for managing moisture that includes a housing having at least one porous layer and a hygroscopic material disposed inside the housing. The porous layer allows moisture and/or water vapor to be transported to the hygroscopic material from an outside space to trap at least a portion of the moisture and/or water vapor from the outside space. The porous layer allows heat generated by at least one electronic system or other heat sources in the outside space to be transmitted to the hygroscopic material to release at least a portion of the water vapor trapped in the hygroscopic material back into the outside space thereby regenerating the hygroscopic material so that it can again trap at a portion of the moisture and/or water vapor.

In another aspect, a system for managing moisture and/or condensation is disclosed having first and second compartments. The first compartment includes, for example, at least one electronic system assembly. The second compartment is disposed, in one example, at least partially below the first compartment and has a hygroscopic material. Water vapor and/or moisture in the first compartment is at least partially adsorbed by the hygroscopic material. The absorbed water vapor is at least partially released from the hygroscopic material by heat generated by the operation of the electronic control assembly to regenerate the hygroscopic material.

In yet another aspect, a method for managing moisture is disclosed having the steps of, for example, trapping in a hygroscopic material at least a portion of water vapor within an electronic enclosure, generating heat within the electronic enclosure by operating at least one electronic control assembly therein, and releasing at least a portion of the water vapor trapped in the hygroscopic material by exposing the hygroscopic material to the heat generated by the electronic assembly.

BRIEF DESCRIPTION OF THE DRAWINGS

In the accompanying drawings which are incorporated in and constitute a part of the specification, disclosures and embodiments of the invention(s) are illustrated, which, together with a general description given above, and the detailed description given below, serve to disclose and exemplify principles of the invention(s).

FIGS. 9A-12B illustrate various embodiments and arrangements of a porous layer.

FIGS. 12A and 12B illustrate further examples of a porous layer.

DETAILED DESCRIPTION

Figure 1A:
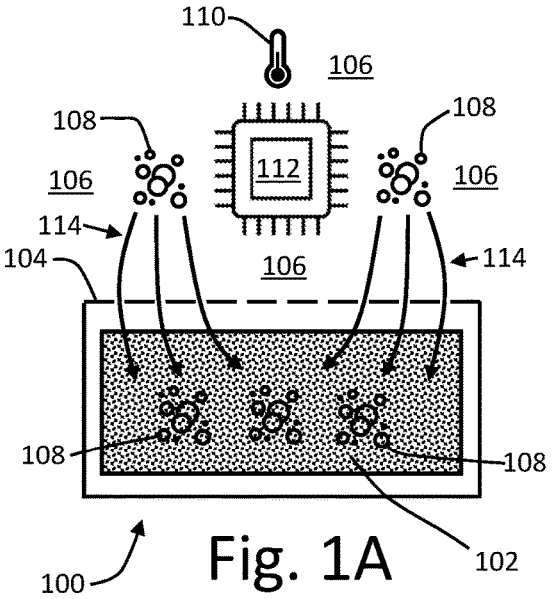
FIGS. 1A and 1B are block diagrams illustrating one embodiment of a system and method for managing moisture.

Various technologies pertaining to a managing moisture within a space are now described with reference to the drawings, wherein like reference numerals are used to refer to like elements throughout. In the following description, for purposes of explanation, numerous specific details are set forth to provide a thorough understanding of one or more aspects. It may be evident, however, that such aspect(s) may be practiced without these specific details. In other instances, structures and devices are shown in block diagram form to facilitate a non-limiting description of one or more aspects of the disclosure. Further, it is to be understood that functionality that is described as being carried out by certain system components may be performed by multiple components. Similarly, for instance, a component may be configured to perform functionality that is described as being carried out by multiple components. Further, when two components are described as being connected, coupled, joined, affixed, in physical communication, etc., it is to be understood that one or more intervening components or parts can be included in such association.

Moreover, the term "or" is intended to mean an inclusive "or" rather than an exclusive "or." That is, unless specified otherwise, or clear from the context, the phrase "X employs A or B" (or other similar phrases) is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

The terms "top" and "bottom," or "upper" and "lower," are used herein for identification purposes. It is contemplated that components disclosed herein can be oriented in substantially any manner consistent with the disclosure. For instance, a top surface need not be above a bottom surface, unless specifically identified in that spatial relationship by the disclosure. Further, as used herein, the term "exemplary" is intended to mean "serving as an illustration or example of something."

Embodiments of the present disclosure provide protection of electrical and/or mechanical systems from outside factors/environments. This includes the management and/or mitigation of water vapor and/or condensation inside an enclosure. The presence of water vapor, and especially condensation, can cause malfunction and/or failure of the components inside the enclosure. This includes corrosion of components, short-circuits, changes in operational properties, material degradation, and other negative effects. Systems and methods are disclosed as having one or more drying apparatuses or arrangements within the enclosure that, for example, do not need to be powered and/or replaced thereby providing reliability and little to no maintenance.

In one embodiment, a hygroscopic material is used to passively adsorb or trap water vapor and/or moisture in a wet environment and to release trapped water vapor and/or moisture within the enclosure when the ambient environment changes from wet to dry. In some embodiments, the trapped water vapor and/or moisture is released by temperature increases caused by heat generated by operation of the electrical and/or mechanical systems inside the enclosure. Release of the trapped water vapor and/or condensation regenerates the hygroscopic material so that it can once again adsorb or trap water vapor and/or condensation during the next environmental change. Thus, a drying apparatus, which may be embedded within an enclosure, provides a continuous drying function when needed without extra power requirements and material replacement. Other examples and configurations are further disclosed herein.

Figure 1B:
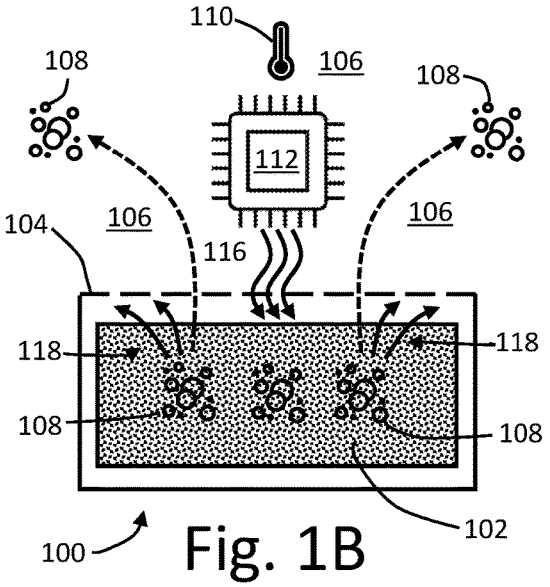

FIGS. 1A and 1B are block diagrams illustrating one embodiment of a system and method for managing moisture. Referring to FIG. 1A, one embodiment of a drying apparatus is provided having a housing 100 that includes a hygroscopic material 102 (or other drying agents). Hygroscopic material 102 can be any material that readily traps moisture, including water vapor and/or condensed water. Non-limiting examples include desiccants such as silica (including gel), molecular sieve(s), clay(s), calcium oxide, and calcium sulfate. The exact type of hygroscopic material is not critical so long as it has the ability to at least partially trap (e.g., adsorb or absorb) moisture and to at least partially release the trapped moisture. In some embodiments, the hygroscopic material 102 is further contained within a packaging that permits moisture through the packaging material and also contains the hygroscopic material preventing it from escaping the packaging (e.g., in the case of dusting of the hygroscopic material 102 caused by bumps, shakes and vibrations or other circumstances).

The apparatus/system also includes a porous material/layer 104, which may be part of housing 100 or connected thereto. As will be described in more detail, layer 104 can include one or more openings or pores therein to allow moisture to pass through the layer (e.g., see FIGS. 13A-D). In other embodiments, layer 104 need not necessarily contain openings or pores therein and still provide an arrangement to allow moisture to move to the hygroscopic material 102 (e.g., see FIGS. 10A-11B). Further, layer 104 can be made from any material that can withstand heating cycles and corrosion from moisture. Non-limiting examples include aluminum, polymers, and ceramics. As will also be described in more detail, the shape and characteristics of layer 104 can be any that allow for water vapor exchange/transfer and/or facilitating liquid water (i.e., condensation) movements away from any sensitive components and to the hygroscopic material 102.

The drying apparatus is typically used in a space or environment 106 where water vapor 108 (and other moisture) may be present. Non-limiting examples of such spaces 106 include the outside environment, spaces within equipment enclosures (e.g., computer equipment, electronic controllers, etc.), spaces within vehicles (e.g., passenger compartments, air conditioning (e.g., heating/cooling) equipment spaces or compartments) and/or any space where control or management of moisture would be beneficial. In the illustrated embodiments, one or more electronic and/or digital systems 112 are within space 106 that can provide heat to space 106 and the drying device. As will be described further, one non-limiting example of an electronic/digital system 112 is a vehicle's on-board computer or control system including, for example, an Autonomous Driving System Computer ("ADSC"). Such computer or control systems include, for example, one or more data/signal processors, memory, input/output controllers (e.g., analog to digital and digital to analog converters), communication ports, power ports, and other related electrical/digital circuitry and components necessary to execute data processing instructions for vehicle operation. Other electrical/digital systems are also intended to be within the herein disclosure.

Still referring to FIG. 1A, when temperature 110 in space 106 drops below or approaches, for example, the dew point of water vapor 108, condensation forms or begins to form in space 106. This is because as the temperature drops, the amount of water vapor 108 that space 106 can retain decreases, which results in water vapor 108 condensing into liquid water. However, water vapor 108 will be drawn (e.g., see arrows 114) to hygroscopic material 102 through layer 104 whereby hygroscopic material 102 will trap at least a portion of the water vapor based on the hygroscopic material's performance characteristics. For example, silica gel can trap moisture approximately up to 40% of its weight. Such trapping of water vapor 108 by hygroscopic material 102 will lessen the amount of water vapor 108 in space 106 where electrical/digital systems 112 are located thus reducing and/or eliminating condensation. This will reduce and/or lessen the negative effects of condensed moisture on any sensitive components such as, for example, printed circuit boards, integrated circuits, and other electrical and/or mechanical components.

Referring now to FIG. 1B, when temperature 110 increases, this will increase the ability of space 106 to retain water vapor 108. In this case, water vapor 108 that has been trapped by hygroscopic material 102 will be released (e.g., see arrows 118). In one example, temperature 110 increases due to the operation of electrical/digital systems 112, which release heat 116 during operation. In some cases, the temperature can reach up to approximately more or less 85° C. (or higher). The heat 116 and increased temperature generated by the operation of electrical/digital systems 112 can be transferred through layer 104 to hygroscopic material 102 to heat hygroscopic material 102. Heating hygroscopic material 102 causes trapped water vapor 108 to be released therefrom (see arrows 118). The heating of hygroscopic material 102 may continue for extended time periods such as, for example, up to 20 hours or more depending on the operation time of electrical/digital systems 112. The longer hygroscopic material 102 is heated, the more trapped water vapor 102 is released. Hygroscopic material 102 does not need to be completely emptied of trapped water vapor 108 in order to be regenerated. It is sufficient for regeneration that at least a portion of the trapped water vapor 108 has been released so that hygroscopic material 102 can again trap water vapor during the next cool down or temperature decrease.

In some embodiments, released water vapor 108 may stay localized to the space near hygroscopic material 102 through the characteristics (e.g., porosity/solidity ratio and/or geometry) of layer 104. This can further reduce the amount of water vapor 108 returning to space 106 in the vicinity of electrical/digital systems 112. Releasing water vapor 108 from hygroscopic material 102 "regenerates" hygroscopic material 102 so that it can again trap water vapor 108 during the next cycle when temperature 110 drops, as described in FIG. 1A.

In this manner, the systems and methods provide a drying function when it is needed without the need for extra power and/or material replacement. When the temperature 110 drops, hygroscopic material 102 traps water vapor 108 when it would otherwise likely begin to condense (FIG. 1A). The hygroscopic material 102 is then regenerated by heat 116 thereby releasing its trapped water vapor 108. Extra power is not needed because the heat 116 is generated by the operation of electrical/digital systems 112, which raise the temperature of hygroscopic material 102 to release the trapped water vapor 108 therein (FIG. 1B). This allows hygroscopic material 102 to again trap water vapor 108 when the temperature cycles lower due to, for example, reduced and/or non-operation of electrical/digital systems 112. Material replacement, e.g., the drying agent or hygroscopic material, is thereby reduced/eliminated due to the regeneration process.

Figure 2A:
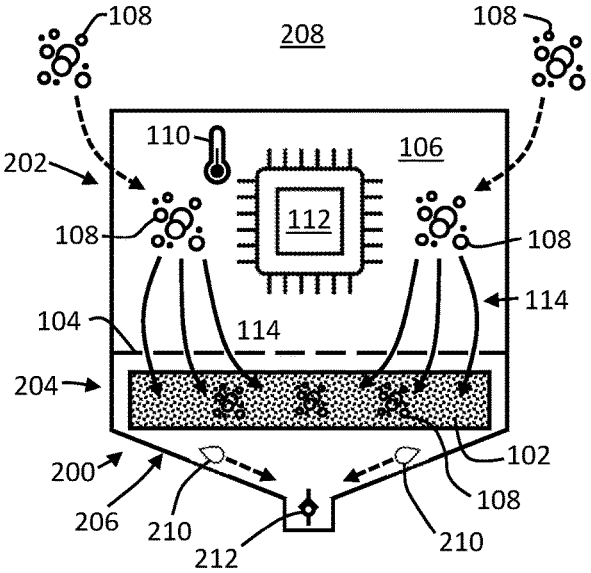
FIGS. 2A and 2B are block diagrams of further embodiments of systems and methods for managing moisture.
Figure 2B:
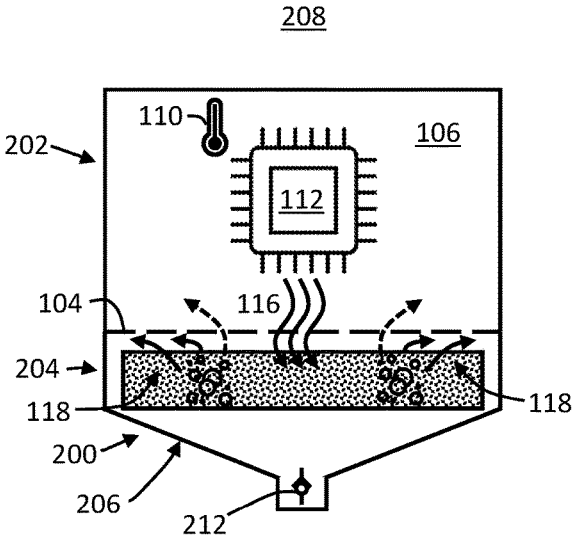

FIGS. 2A and 2B are block diagrams of further embodiments of systems and methods for managing moisture. Referring to FIG. 2A, an enclosure or housing 200 is provided. Housing 200 can be, for example, an electronics housing or enclosure for a controller, computer system, and/or other electrical/mechanical devices. In one example, housing 200 can be for enclosing an electrical/digital system 112 such as a vehicle ADSC or other vehicle computer or control system. Further yet, housing 200 can be water-tight and/or air-tight to varying specifications including not being air-tight at all but just water-tight (e.g., an IP5K2 enclosure, or similar).

Housing 200 includes a first portion or compartment 202 and a second portion or compartment 204. In one embodiment, first compartment 202 can be an upper compartment and second compartment 204 can be a lower compartment. Housing 200 can also include layer 104 (as previously described) between the first and second compartments 202 and 204. Layer 104 can also be part of first compartment 202, second compartment 204 or its own discrete component.

First compartment 202 includes space 106 and one or more electrical/digital systems 112. Second compartment 204 has a space that includes hygroscopic material 102 and one or more optionally sloped portions 206. The sloped portions 206 can include, for example, funnel, conical, triangular, and other shapes. The exact shape is not important so long as it can direct moisture (including condensation 210) to one or more areas of the compartment. The sloped portions 206 can be more or less sloped than illustrated and do not need to be same slope. These areas can include for example a drain area having one or more valve devices 212. Non-limiting examples of valve devices 212 include one-way valves such as, for example, check valves, non-return valves, etc. Other valves can also be used including powered and passive valves. Valve device 212 functions to allow moisture such as, for example, condensation 212 to drain or exit from housing 200 and/or compartment 204. This optional arrangement can provide a failsafe that allows drainage from housing 200 should excessive moisture be present.

Still referring to FIG. 2A, when housing 200 is not completely air-tight, water vapor 108 may be drawn into housing 200 from outside space 106. This can occur when the temperature 110 in inside space 106 is below the temperature in outside space 208 or the humidity in inside space 106 is below the humidity in outside space 208 under the same temperatures. In one example, a vehicle such as an autonomous driving vehicle (see, e.g., FIG. 14) may have been dormant during the night when temperatures in outside space 208 typically drop below daytime temperatures. The temperature 110 in inside space 106 containing electrical/digital systems 112 (e.g., an ADSC) will also tend to drop because during vehicle dormancy electrical/digital systems 112 are either not operating, operating in some energy saving mode, or other reduced operation capacity and thus not generating elevated levels of heat. As the outside space 208 temperature begins to increase with approaching daytime, the temperature in inside space 106 lags behind. This temperature difference can cause water vapor 108 from outside space 208 to be drawn into inside space 106 because housing 200 is not completely airtight. Water vapor 108 in inside space 106 and first compartment 202 will be drawn (e.g., see arrows 114) to hygroscopic material 102 in the second compartment 204 through layer 104. Hygroscopic material 102 will trap at least a portion of the water vapor 108 as previously described in connection with FIG. 1A. Thus, at least a portion of the moisture and/or water vapor 108 contained in first compartment 202 will be removed and trapped by second compartment 204 to protect electrical/digital systems 112, as previously described.

In one particular example, first compartment 202 can be an upper compartment located above second compartment 204, which can be a lower compartment. In this example, the upper and lower arrangement of compartments can use the force of gravity on moisture and/or water vapor 108 to assist in their movement from upper compartment 202 to lower compartment 204 where they are trapped by the hygroscopic material 102 and/or optionally drained out of the housing via optional valve device 212. The exact arrangement of upper and lower compartments is not critical as long as they are arranged so that the force of gravity may provide some assistance in movement or transfer of the moisture and/or water vapor 108 to the hygroscopic material 102 and/or optional drain device 212. Such trapping of water vapor 108 by hygroscopic material 102 will lessen the amount of water vapor 108 in space 106 where electrical/digital systems 112 are located thus reducing and/or eliminating the risk of condensation. This will reduce and/or lessen the negative effects of condensed moisture on sensitive components such as, for example, printed circuit boards, integrated circuits, and other electrical and/or mechanical components.

Referring now to FIG. 2B, the temperature 110 inside first compartment 202 and space 106 will increase when electrical/digital systems 112 actively operate. High daytime temperatures may also contribute to this increase in temperature 110. This temperature increase allows first compartment 202 and space 106 to retain more water vapor 108 compared to decreased temperatures. And, water vapor 108 that has been trapped by hygroscopic material 102 in the second compartment 204 will begin to be released (e.g., see arrows 118). The heat 116 and increased temperature generated by the operation of electrical/digital systems 112 is at least partially transferred through layer 104 to hygroscopic material 102 to heat and/or raise the temperature in second compartment 204 and/or the hygroscopic material 102. Heating hygroscopic material 102 and/or the space around it causes trapped water vapor 108 to be released therefrom (see arrows 118).

As previously described in connection with FIG. 1A, released water vapor 108 may stay localized in second compartment 204 through the characteristics (e.g., porosity ratio and/or geometry) of layer 104 thereby making layer 104 act as at least a partial lid or retaining cover. This partial lid function can further reduce the amount of water vapor 108 returning to first compartment 202 and space 106 in the vicinity of electrical/digital systems 112. And, releasing trapped water vapor 108 from hygroscopic material 102 "regenerates" hygroscopic material 102 so that it can again trap water vapor 108 during the next cycle when temperature 110 drops (e.g., FIG. 2A).

Figure 3:
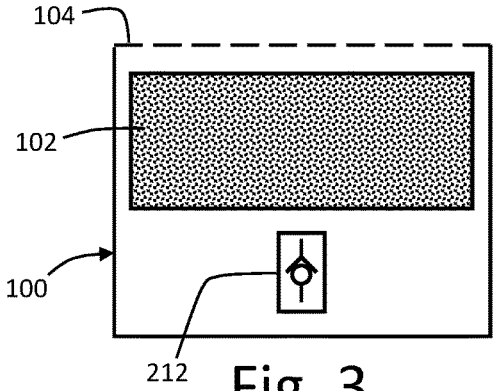
FIGS. 3 and 4 are block diagrams illustrating various embodiments of optional devices that can be included as part of the systems and methods for managing moisture.
Figure 4:
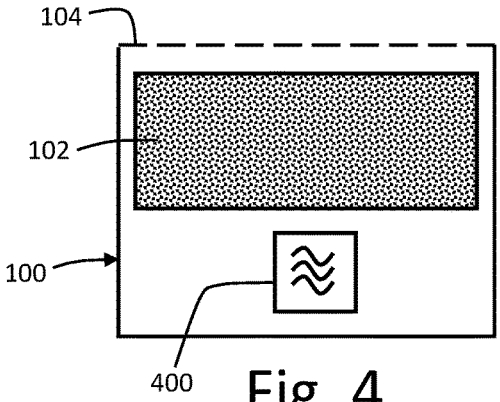

FIGS. 3 and 4 are block diagrams illustrating various embodiments of optional devices that can be included as part of or within housing/enclosures 100 and/or 200 (and/or inside first and/or second compartments 202 and 204, respectively). These include the previously described valve device 212 (FIGS. 2A-2B & 3) and a venting device 400 (FIG. 4). Valve device 212 is generally directed to releasing trapped moisture in the form of liquid condensation 210 (e.g., see FIG. 2A). Venting device 400 is directed to releasing moisture in the form of water vapor 108. Non-limiting examples of venting device 400 include pressure actuated check valves that operate to open when the pressure inside housing 100 (and/or inside first and/or second compartments 202 and 204, respectively) is greater than the outside pressure in for example outside space 208 (FIGS. 2A-2B). Other types of venting devices can also be used including powered vents controlled by electrical or mechanical signals based on pressure and/or moisture readings/sensors.

Figure 5:
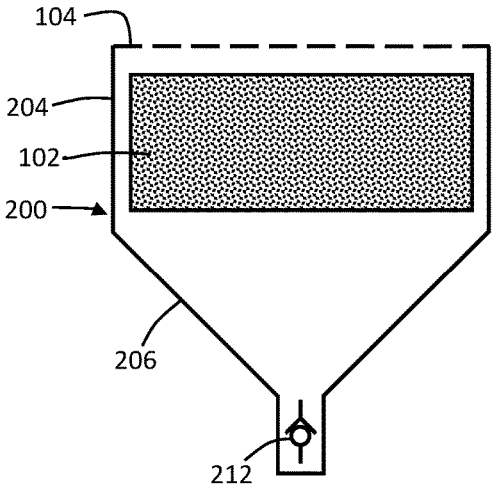
FIGS. 5-8 are block diagrams illustrating various embodiments of a hygroscopic material.
Figure 6:
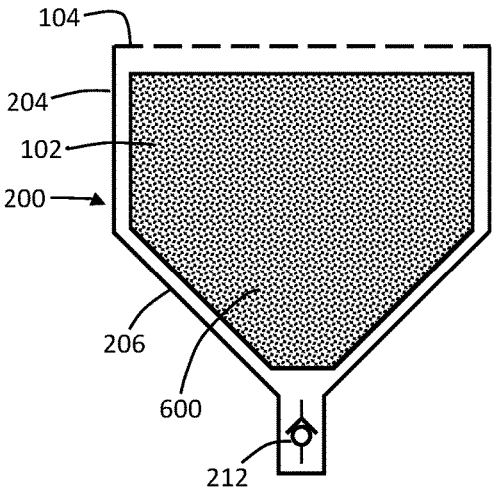
Figure 7:
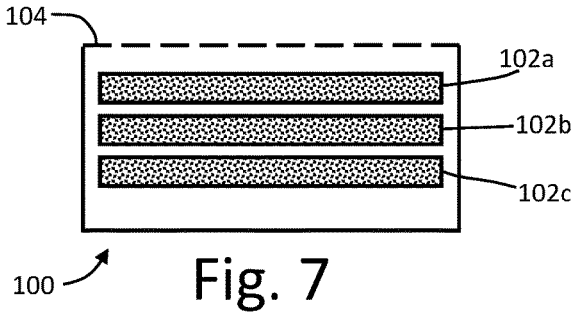
Figure 8:
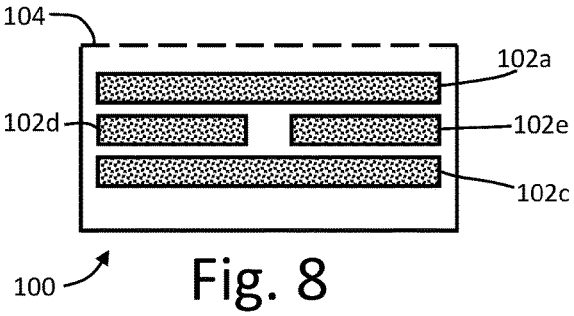

FIGS. 5-8 are block diagrams illustrating various embodiments of hygroscopic material 102. Referring to FIG. 5, hygroscopic material 102 is located within the second compartment 204. In this embodiment, hygroscopic material 102 does not necessarily extend into the sloped portion 206 but can as will be described. Referring now to FIG. 6, hygroscopic material 102 is also shown located within second compartment 204. In this embodiment, hygroscopic material 102 at least partially extends into the sloped portion 206 and provides an increased amount of hygroscopic material compared to, for example, the embodiment of FIG. 5. In some embodiments, hygroscopic material 102 is located within second compartment 204 but spaced apart from the walls of the compartment to allow for drain channels to direct any condensation or liquid water to designated areas (e.g., like the area containing valve device 212). In other embodiments, hygroscopic material 102 may contact one or more housing 100 or compartment 204 perimeter walls thereby providing fewer or even no drainage channels. FIG. 7 illustrates an embodiment where hygroscopic material 102 comprises multiple portions 102*a*, 102*b*, and 102*c*. In this embodiment, portions 102*a*, 102*b*, and 102*c* are spaced apart forming flow channels for gas or water vapor and providing increased surface exposure for the hygroscopic material to trap moisture. FIG. 8 is similar to FIG. 7 except that hygroscopic portion 102*b* comprises two portions 102*c* and 102*d* that are spaced apart by a gap. Other shapes and geometries that include these same benefits can also be used.

Figure 9A:
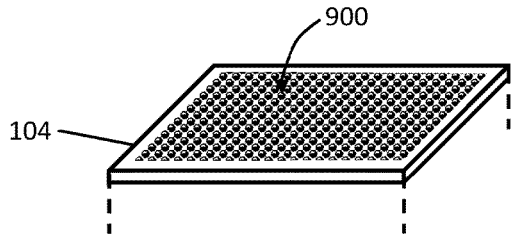
Figure 9B:
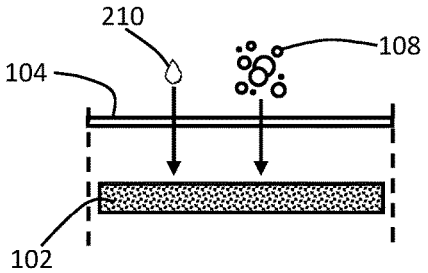

FIGS. 9A-12B illustrate various embodiments and arrangements of porous layer 104. As previously described, layer 104 can be made from any material that can withstand heating cycles and corrosion from moisture including, for example, aluminum, polymers, and ceramics. The shape and characteristics of layer 104 can be any that allow for water vapor exchange/transfer and/or facilitating liquid water (i.e., condensation) movements away from any sensitive components and to the hygroscopic material 102. FIGS. 9A-9B illustrate one embodiment of a plate-like shape for layer 104. This embodiment is substantially flat and includes one or more pores or other openings 900 that are formed through the body of layer 104. The pores or other openings 900 allow water vapor 108 and/or liquid water 210 to pass through toward hygroscopic material 102. Examples of various pores or opening will be described in connection with FIGS. 13A-D).

Figure 10A:
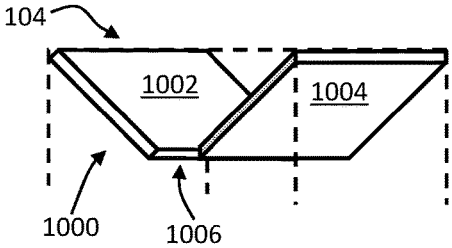
FIGS. 10A-10B illustrate a second embodiment of porous layer having multiple portions or sections.
Figure 10B:
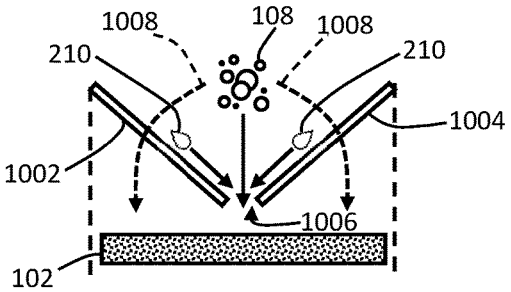
Figure 11A:
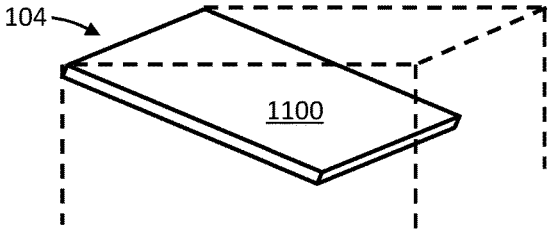
FIGS. 11A-11B are similar to FIGS. 10A-10B except the porous layer has a single section sloped to one side of a compartment housing.
Figure 11B:
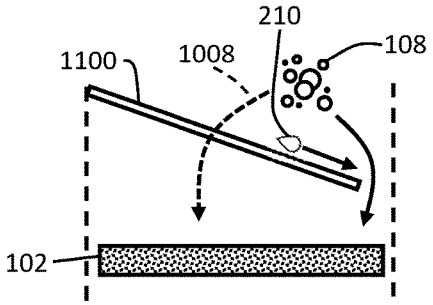

FIGS. 10A-10B illustrate a second embodiment of layer 104 having multiple portions or sections 1002 and 1004. In this embodiment, layer portions 1002 and 1004 are substantially flat, but can include minor arcs, curves, and channels that promote liquid water movement towards hygroscopic material 102. Layer portions 1002 and 1004 can be arranged in a sloped configuration as shown to direct moisture towards an opening or gap 1006 leading to hygroscopic material 102. In this embodiment, layer portions 1002 and 1004 can optionally include one or more pores or openings through the bodies thereof (similar to that of FIGS. 9A-9B) to promote the movement of liquid water 210 and/or water vapor 108 (see arrows 1008) towards hygroscopic material 102. FIGS. 11A-11B are similar to FIGS. 10A-10B except that layer 104 has a single portion or section 1100 sloped to one side of the compartment housing.

Figure 12A:
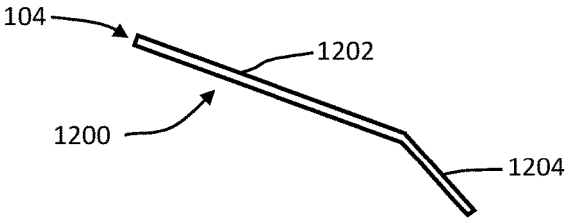
Figure 12B:
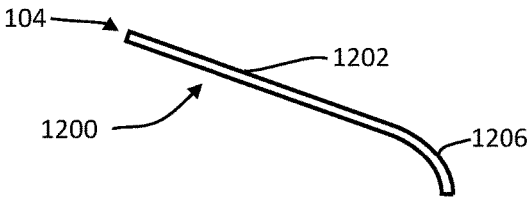

FIGS. 12A and 12B illustrate other examples of layer 104. FIG. 12A illustrates one embodiment of layer 104 that includes a body 1200 having multiple sections 1202 and 1204. Section 1202 can be sloped at a first angle and section 1204 can be sloped or bent according to a second angle, which may be greater than the first angle. The embodiment of FIG. 12B is similar except that it includes a section 1206 that is arched or curved. Additional arched and/or bent sections can also be employed. In either embodiment, sections 1204 and 1206 promote the movement of liquid water towards a space containing a hygroscopic material or other designated drainage space/device.

Figure 13A:
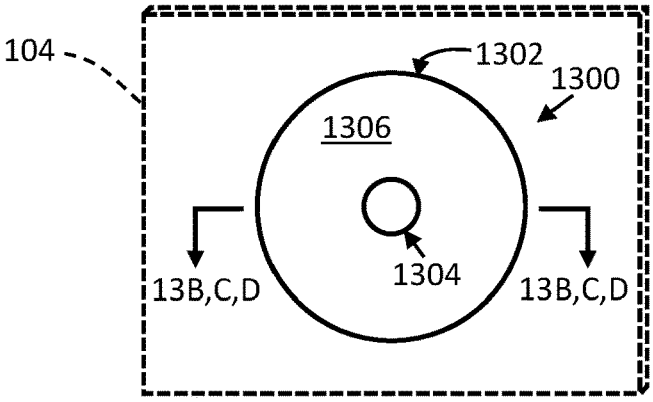
FIGS. 13A-13D illustrate various embodiments of pores or openings in a porous layer.

FIGS. 13A-13D illustrate various embodiments of pores or openings in layer 104. FIG. 13A illustrates a top view of one embodiment of a pore or opening 1300 having a round shape such as, for example, a circular or elliptical shape. Other shapes can be used as well including polygonal (e.g., triangular, square, rectangular, pentagonal, hexagonal, etc.)

and combinations of the foregoing. The size and configuration of pore or opening 1300 can include one relatively large opening, multiple large openings, many small openings, a combination of large and small openings (e.g., larger openings around perimeter and smaller toward center or vice-versa), gradual size and shape change of openings from perimeter to center and vice-versa, offset where one size/shape is disposed offset (including gradually) towards one side or multiple sides of layer 104, etc. The solidity (ratio of solid to open area) of layer 104 can be any solidity whereby sufficient open area (e.g., area of the pores) is provided to allow water vapor 108 and/or liquid water 210 to pass through layer 104 to hygroscopic material 102 thereby reducing the moisture in the space(s) proximate electrical/digital systems 112 or other sensitive components and to allow enough heat transfer to hygroscopic material 102 to allow regeneration thereof. Examples of layer 104 solidity include between more or less than 0.10% to 50% or more. Pores 1300 can be formed in place, perforated, drilled, cast, molded, etc. Also, any shape can be used including, for example, shapes conducive to the removal of liquid condensation and moisture including the use of gravity to assist in the movement.

Figure 13B:
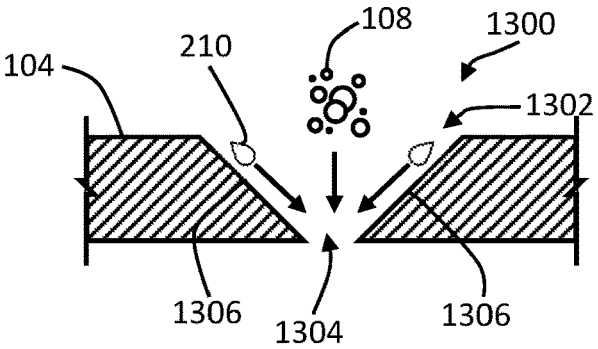
Figure 13C:
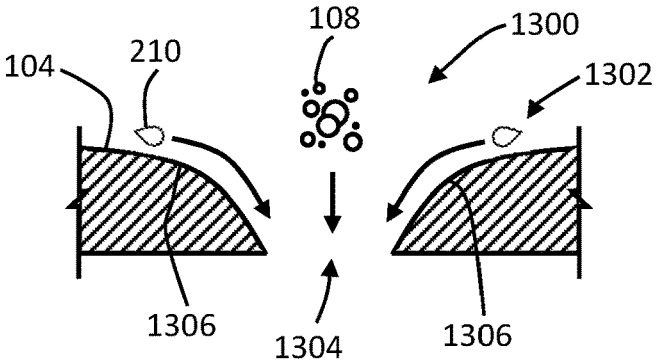
Figure 13D:
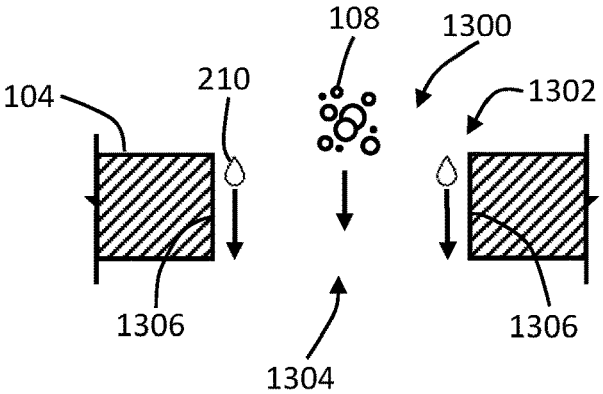

Still referring to FIG. 13A, one embodiment of pore 1300 includes first and second openings 1302 and 1304 and a through wall 1306. FIGS. 13B, 13C, and 13D show various cross-sectional embodiments of pore 1300. FIG. 13B illustrates walls 1306 that are substantially straight and sloped at an angle. Water vapor 108 can move through pore 1300 to hygroscopic material 102 via pore openings 1302 and 1304. Angled walls 1306 allow liquid water or condensation 210 to travel along the surface thereof and to exit the second opening 1304 away from sensitive electrical and mechanical components and to the space or compartment having hygroscopic material 102. FIG. 13C illustrates a similar embodiment except that walls 1306 are arched or curved to promote the liquid water or condensation 210 to travel along the surface thereof. In the exemplary embodiments of FIGS. 13B and 13C, the second opening 1304 is smaller in size than the first opening 1302 thus providing a countersunk configuration or arrangement. This arrangement can assist the previously described "lid" function of layer 104 by making it more difficult for water vapor 108 and liquid water 210 to travel in the opposite direction (e.g., away from hygroscopic material 102 and towards sensitive electrical and mechanical components). FIG. 13D illustrates another cross-sectional embodiment of pore 1300 having substantially vertical through walls 1306. The exact shape and configuration of pores 1300 are not critical so long as water vapor 108 can move to hygroscopic material 102 and liquid water or condensation is directed away from sensitive electronics and mechanics.

Figure 14:
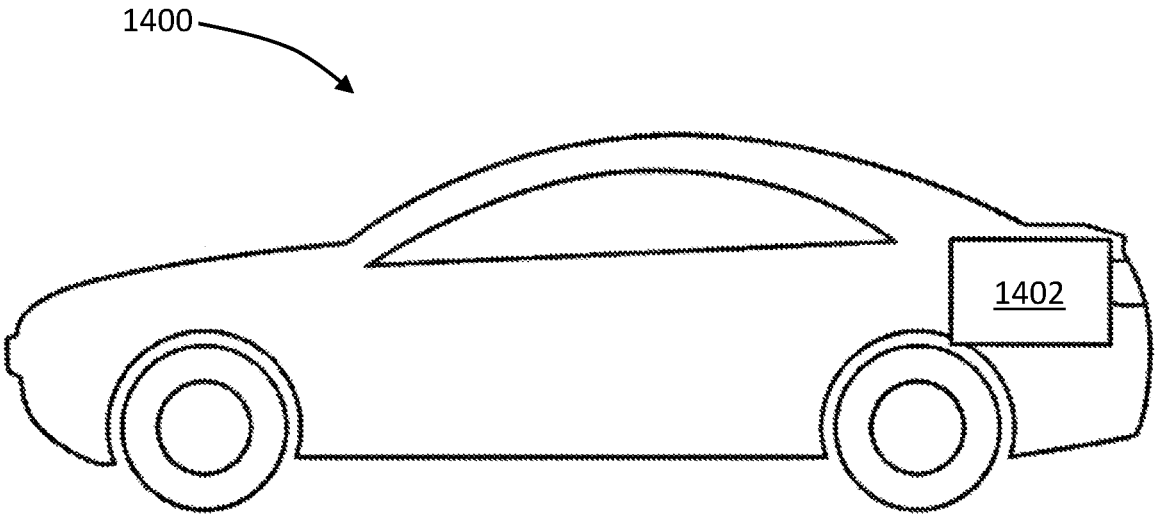
FIG. 14 illustrates one embodiment of a vehicle having a drive computer system employing at least one embodiment of the systems and/or methods for managing moisture disclosed herein.

As previously mentioned, embodiments of the present disclosure include enclosures for vehicle drive computer or control systems. FIG. 14 illustrates one embodiment of a vehicle 1400 having a drive computer or control system 1402 that employs at least one embodiment of the systems and/or methods for managing moisture disclosed herein. One particular example includes vehicle 1400 being an autonomous driving vehicle and drive computer system 1402 being an Autonomous Driving Computer Systems (ADSC) having one or more of the system(s)/method(s) for managing moisture disclosed herein. An autonomous vehicle is a motorized vehicle that can operate without human conduction by use of the ADSC. An exemplary autonomous vehicle includes a plurality of sensor systems, such as but not limited to, a lidar sensor system, a camera sensor system, and a radar sensor system, amongst others that assist the ADSC to operate and drive the vehicle.

ADSC's and related vehicle computing devices can control various vehicle functions. Examples of vehicle functions that can be controlled include driving control (e.g., propulsion, steering, braking, etc.), localization of the autonomous vehicle (e.g., determining a local position of the autonomous vehicle), perception of objects nearby the autonomous vehicle (e.g., detecting, classifying, and predicting the behavior of the objects nearby the autonomous vehicle), a combination thereof, and so forth. According to an illustration, sensor signals from a sensor system can be inputted to an autonomous vehicle computing device. Moreover, pursuant to another illustration, a sensor system can include an autonomous vehicle computing device.

Autonomous vehicles can operate sometimes for up to 20 hours per day. During such operation, the temperature inside the enclosure or housing where the ADSC resides can reach as high as 85° C. or more due to the heat generated by the central processing unit (CPU) and other electrical components thereof. As described herein, these elevated temperatures generated by the ADSC and the ADSC's long times of operation can be used to regenerate the drying agent or hygroscopic material within the ADSC enclosure or housing (e.g., see, FIGS. 1B & 2B and related descriptions). On colder nights after warm and humid days, water vapor within the enclosure of the ADSC may begin to condense (especially if the ADSC is not generating heat or significant heat). During this occurrence, the drying agent or hygroscopic material will trap at least a portion of the water vapor thereby reducing and/or eliminating water condensation inside the ADSC enclosure.

Further, while the example of a vehicle driving system or ADSC enclosure of housing has been described, other enclosures may also benefit from the systems and methods disclosed herein. These include trunk compartments, engine compartments, passenger compartments, etc. Further yet, the systems and methods disclosed herein can be layered. For example, a first system for managing moisture can be used by an ADSC and its enclosure and a second system can be used in the space (e.g., passenger, trunk, or other compartments) where the ADSC and its enclosure are located.

Hence, the systems and methods disclosed provide a drying function when it is needed without the need for extra power and/or material replacement. When temperatures drop, the hygroscopic material traps water vapor when it would otherwise likely begin to condense (e.g., see FIGS. 1A & 2A). The hygroscopic material is then regenerated by heat formed by operating electrical/digital systems (e.g., an ADSC) thereby releasing the water vapor trapped in the drying agent or hygroscopic material. Extra power is not needed to regenerate the drying agent or hygroscopic material because the regenerating heat is provided by the operation of electrical/digital systems, which raise the temperature of the hygroscopic material to release the trapped water vapor therein over time (e.g., see FIGS. 1B & 2B). This allows the hygroscopic material to again trap water vapor when the temperature cycles lower due to, for example, reduced and/or non-operation of electrical/digital systems. Due to regeneration, replacement of the drying agent or hygroscopic material is reduced/eliminated.

Systems and methods have been described herein in accordance with at least the examples set forth below.

(A1) In one aspect, a system for managing condensation includes a first compartment having at least one electronic control assembly, and a second compartment disposed at least partially below the first compartment and having a hygroscopic material. Water vapor in the first compartment is at least partially adsorbed by the hygroscopic material, and water vapor is at least partially released from the hygroscopic material by heat generated by electronic control assembly operation.

(A2) In some embodiments of the system of (A1), the second compartment further includes a first porous material at least partially retaining the hygroscopic material.

(A3) In some embodiments of at least one of the systems of (A1)-(A2), the hygroscopic material includes a desiccant material.

(A4) In some embodiments of at least one of the systems of (A1)-(A2), the hygroscopic material includes silica material.

(A5) In some embodiments of at least one of the systems of (A1)-(A4), the at least one electronic assembly includes an autonomous driving system computer.

(A6) In some embodiments of at least one of the systems of (A1)-(A5), the system further includes a second porous material disposed at least partially between the first and second compartments.

(A7) In some embodiments of at least one of the systems of (A1)-(A6), the water vapor in the first compartment is at least partially adsorbed by the hygroscopic material when the electronic assembly is not in an active control mode.

(A8) In some embodiments of at least one of the systems of (A1)-(A7), the second compartment further includes a valve for the release of water vapor condensate out of the second compartment.

(A9) In some embodiments of at least one of the systems of (A1)-(A8), the second compartment further includes a check valve disposed at least partially below the hygroscopic material.

(A10) In some embodiments of at least one of the systems of (A1)-(A9), the second compartment further includes a funnel portion disposed at least partially below the hygroscopic material.

(B1) In another aspect, a system for managing condensation includes a housing having: a first porous layer including at least one opening to a space outside the housing; and a hygroscopic material disposed inside the housing. The first porous layer allows water vapor to be transported to the hygroscopic material from the outside space to trap at least a portion of the outside space water vapor, and the first porous layer allows heat generated by at least one electronic data processing system disposed in the outside space to be transmitted to the hygroscopic material to release at least a portion of the water vapor trapped in the hygroscopic material back into the outside space.

(B2) In some embodiments of the system of (B1), the hygroscopic material includes a desiccant material.

(B3) In some embodiments of the system of (B1), the hygroscopic material includes silica material.

(B4) In some embodiments of at least one of the systems of (B1)-(B3), the housing further includes a funnel portion disposed at least partially below the hygroscopic material.

(B5) In some embodiments of at least one of the systems of (B1)-(B4), the housing further includes a valve device disposed at least partially below the hygroscopic material.

(B6) In some embodiments of at least one of the systems of (B1)-(B5), the housing further includes a funnel portion and valve device.

(C1) In another aspect, a method of managing condensation includes trapping in a hygroscopic material at least a portion of water vapor within an electronic enclosure. The method also includes generating heat within the electronic enclosure by operating at least one electronic control assembly therein. Further, the method includes releasing at least a portion of the water vapor trapped in the hygroscopic material by exposing the hygroscopic material to the heat generated by the electronic assembly.

(C2) In some embodiments of the method of (C1), trapping in a hygroscopic material at least a portion of water vapor within an electronic enclosure includes trapping in a desiccant material at least a portion of water vapor within the electronic enclosure.

(C3) In some embodiments of at least one of the methods of (C1)-(C2), trapping in a hygroscopic material at least a portion of water vapor within an electronic enclosure includes trapping in a silica material at least a portion of water vapor within the electronic enclosure.

(C4) In some embodiments of at least one of the methods of (C1)-(C3), generating heat within the electronic enclosure by operating at least one electronic control assembly therein includes generating heat within the electronic enclosure by operating at least one autonomous driving system computer.

What has been described above includes examples of one or more embodiments. It is, of course, not possible to describe every conceivable modification and alteration of the above devices or methodologies for purposes of describing the aforementioned aspects, but many further modifications and permutations of various aspects are possible and meant to be included within the disclosure herein. Accordingly, the described aspects are intended to embrace all such alterations, modifications, and variations that fall within the scope of the appended claims. Furthermore, to the extent that the term "includes" is used in either the details description or the claims, such term is intended to be inclusive in a manner similar to the term "comprising" as "comprising" is interpreted when employed as a transitional word in a claim.

What is claimed is:

1. A system for managing condensation comprising:

a first compartment comprising an enclosed space containing at least one electronic control assembly disposed within the first compartment; where the first compartment is configured to permit water vapor to enter the enclosed space;

a second compartment disposed below the first compartment containing a hygroscopic material;

wherein the water vapor in the first compartment is at least partially adsorbed by the hygroscopic material; and wherein the adsorbed water vapor is at least partially released from the hygroscopic material by heat generated by electronic control assembly operation.

2. The system of claim 1 wherein the second compartment further comprises a first porous material at least partially retaining the hygroscopic material.

3. The system of claim 1 wherein the hygroscopic material comprises a desiccant material.

4. The system of claim 1 wherein the hygroscopic material comprises silica material.

5. The system of claim 1 wherein the at least one electronic control assembly comprises an autonomous driving system computer.

6. The system of claim 1 further comprising a second porous material disposed at least partially between the first and second compartments.

7. The system of claim 1 wherein the water vapor in the first compartment is at least partially adsorbed by the hygroscopic material when the electronic control assembly is not in an active control mode.

8. The system of claim 1 wherein the second compartment further comprises a valve for the release of water vapor condensate out of the second compartment.

9. The system of claim 1 wherein the second compartment further comprises a check valve disposed at least partially below the hygroscopic material.

10. The system of claim 1 wherein the second compartment further comprises a funnel portion disposed at least partially below the hygroscopic material.

11. A system for managing condensation, comprising:

a housing enclosure having:

a first porous layer comprising at least one opening to a space outside the housing enclosure; and a hygroscopic material disposed inside the housing enclosure;

at least one electronic data processing system configured to generate heat is disposed in the space outside the housing enclosure;

wherein the first porous layer is configured to allow water vapor to be transported to the hygroscopic material from the space outside the housing enclosure and to trap at least a portion of the water vapor on the hygroscopic material; and wherein the first porous layer is further configured to allow heat generated by the at least one electronic data processing system to be transmitted to the hygroscopic material and then release at least a portion of the trapped water vapor.

12. The system of claim 11 wherein the hygroscopic material comprises a desiccant material.

13. The system of claim 11 wherein the hygroscopic material comprises silica material.

14. The system of claim 11 wherein the housing enclosure further comprises a funnel portion disposed at least partially below the hygroscopic material.

15. The system of claim 11 wherein the housing enclosure further comprises a valve device disposed at least partially below the hygroscopic material.

16. The system of claim 11 wherein the housing enclosure further comprises a funnel portion and valve device.

17. A method of managing condensation, comprising:

providing an electronic enclosure disposed in a first compartment that is configured to permit water vapor to enter the electronic enclosure;

trapping a portion of the water vapor from the electronic enclosure onto a hygroscopic material disposed in a second compartment, wherein the second compartment is separated from the first compartment by a first porous layer;

generating heat within the electronic enclosure by operating at least one electronic control assembly therein; and releasing at least a portion of the water vapor trapped in the hygroscopic material by exposing the hygroscopic material to the heat generated by the electronic control assembly.

18. The method of claim 17 wherein trapping in the hygroscopic material at least a portion of the water vapor within the electronic enclosure comprises trapping in a desiccant material at least a portion of the water vapor within the electronic enclosure.

19. The method of claim 17 wherein trapping in the hygroscopic material at least a portion of the water vapor within the electronic enclosure comprises trapping in a silica material at least a portion of the water vapor within the electronic enclosure.

20. The method of claim 17 wherein generating heat within the electronic enclosure by operating the at least one electronic control assembly therein comprises generating heat within the electronic enclosure by operating at least one autonomous driving system computer.

* * * * *